US005561277A

United States Patent [19]

Bockhold et al.

[11] Patent Number: 5,561,277

[45] Date of Patent: Oct. 1, 1996

[54] DUAL PROCESSOR CONTROL SYSTEM WITH CONTINUOUS PARALLEL INTERFACE INTEGRITY TESTING

[75] Inventors: Philip J. Bockhold; Clara S. Johnson, both of Memphis, Tenn.

[73] Assignee: Delaware Capital Formation, Inc., Wilmington, Del.

[21] Appl. No.: 213,097

[22] Filed: Mar. 15, 1994

[51] Int. Cl.[6] ..... B66B 5/00

[52] U.S. Cl. ..... 187/247; 187/393; 187/277; 371/20.4

[58] Field of Search ..... 187/390, 393, 187/247, 277, 391; 371/3, 204

[56] References Cited

U.S. PATENT DOCUMENTS 4,811,278 3/1989 Bean et al. ..... 364/900
5,007,054 4/1991 Lee et al. ..... 371/32
5,139,113 8/1992 Mizuno et al. ..... 187/133
5,202,540 4/1993 Auer et al. ..... 187/101
5,349,684 9/1994 Edem et al. ..... 395/800

*Primary Examiner*—Robert Nappi
*Attorney, Agent, or Firm*—White & Case

[57] ABSTRACT

A control system comprises a first processor that generates 16-bit control words and a 16-bit interface check word representing the ones complement of each control word. Preferably, each word is formed as two 8-bit bytes, which are transmitted sequentially to a second processor over an 8-bit parallel interface. The second processor compares each control word with its corresponding interface check word to detect any parallel interface hardware component failures. Preferably, the high and low bytes of the interface check word are swapped prior to transmission to the second processor, and the second processor restores the swaps of the high and low bytes of the interface check word prior to comparing.

5 Claims, 10 Drawing Sheets

DUAL PROCESSOR CONTROL SYSTEM WITH CONTINUOUS PARALLEL INTERFACE INTEGRITY TESTING

FIELD OF INVENTION

The present invention relates to control systems of the type where digital control signals are generated in a first processor and then transmitted to a second processor, over a parallel interface. The invention has particular application in the field of elevator motor drive control systems, where speed control signals need to be transmitted from the controller to the motor drive, and will be described with reference to such application.

BACKGROUND OF THE INVENTION

Conventional traction elevators include a motor, for moving the car between floors, a static drive that dictates the speed and direction of rotation of the motor, and a car logic controller that controls the drive in response to various elevator operating conditions, such as the activation of car and hall call buttons, the position of the doors, the activation of safeties and, in multiple car elevator banks, commands from the group supervisory control. When responding to a hall or car call, one of the functions of the controller is to generate speed control signals, based on a selected speed profile, to move the car quickly and smoothly to the target floor. The speed control signals are fed to the static drive which, in turn, produces an appropriate voltage and current output such that the motor rotates at the dictated speed.

Historically, solid state elevator drives were speed regulated with an analog speed reference signal. The speed reference signal was generated using analog operational amplifiers (op amps) and, generally, was normalized to 7 volts for rated speed. This signal was then compared to an actual speed signal, generated by a tachometer, and the difference was used to correct the speed of the motor. The ability to control speed accurately, however, was limited by the inherent limitations of op amps.

The problems associated with linear integrated circuits resulted in the development of new methods for generating the speed reference signal. The most reliable systems employ digital speed reference signals to control elevator speed. To do so requires transmitting signals to the static drive over a serial or parallel data transmission link.

In a typical digital speed control system today, the controller transmits to the static drive not only speed reference values, but also initial current offset signal pre-torque reference values. The latter signals are used at the beginning of a run, to pre-torque the motor prior to releasing the brake, thereby preventing unintended car movement in the interval between the time the brake is released and the time the motor begins to move the car. The speed command and pre-torque signals are stored in separate registers in the static drive microcomputer. The drive microprocessor also receives motor speed feedback signals, and generates appropriate motor control signals based upon the difference between the requested speed and the actual speed.

Each speed reference value and pre-torque reference value is in the form of a 16-bit word, which is sent to the static drive through an 8-bit parallel interface port. In order to do so, the 16-bit word is divided into two bytes: a high byte (MSB) and a low byte (LSB), which are transmitted sequentially.

Three control interface ports link the static drive and controller microprocessor: speed reference select $S_{REF}$, pre-torque reference select $I_{REF}$, and byte select. The controller monitors the $S_{REF}$ and $I_{REF}$ lines, and interrupts on a change from one to zero from either line. The static drive requests updates of the control signals, at predetermined time intervals, by transmitting to the controller either a speed reference select or a pre-torque reference select signal, and either a byte select high MSB or byte select low LSB signal, i.e., representing half of the 16-bit control word. The controller scales and loads the $S_{REF}$ and $I_{REF}$ values into their respective registers, and transmits the first byte of the requested parameter to the drive. The drive then changes the byte select signal, to receive the second byte (other half) of the selected parameter, and then repeats the process for the other parameter.

By way of illustration, FIG. 1 is a schematic diagram of a controller and static drive, in which the controller has scaled and loaded values of $S_{REF}$ and $I_{REF}$, each of which is a two byte, 16-bit, twos complement number, into separate 16-bit registers. FIG. 1 illustrates the first of four load-in steps, in which the static drive sends a Speed Reference Select bit "1" to port "Speed", and a byte select bit "1" to port "Byte", in response to which the MSB of the speed control signal $S_{REF}$ is transmitted from the controller to the drive. The static drive processor stores the high byte in the appropriate half of the speed control register. Thereafter, the drive changes the byte select bit to "0", to load in the low byte (LSB).

After the high and low byte of the speed reference have been transmitted to the drive, the drive microprocessor requests the first byte MSB of the pre-torque value by setting the Speed select bit to "0", the Torque select bit to "1", and the Byte select bit to "1". Finally, the drive changes the byte select bit to "0" to receive the second byte (LSB) of the pre-torque reference, thus completing the process.

Each data bit port of the parallel interface just described employs an optocoupler switch, that sets the output signal at either "0" or "1", respectively as a result of a command from the controller microprocessor. The static drive has buffers at the receiving end for noise immunity. The bit ports "Byte", "Torque", and "Speed" on the static drive are controlled in the same manner, but by the drive microprocessor. Occasionally, these switches can become stuck, in which case faulty signals will be transmitted from one microprocessor to the other microprocessor.

It is therefore important to conduct periodic parallel interface integrity tests to detect any parallel interface hardware component failure. Presently, such tests are performed when the elevator is first powered up (approximately 15 seconds after main power initialization, which is the time necessary to give the elevator controller and static drive processors time to initialize their individual systems), and also when the elevator is in a stopped condition.

In performing the integrity test, the controller stores a zero speed request in the $S_{REF}$ register, and the one's complement of the zero speed request in the $I_{REF}$ register, as shown in FIG. 2. Each byte is then transmitted to the controller, and the controller verifies that the $I_{REF}$ is in fact the ones complement of $S_{REF}$. If for six consecutive readings an error is detected, the system shuts down.

There are a number of drawbacks to the present system. If the byte select line from the drive is stuck, the high byte or low byte would be read twice during the integrity test. However, because the value of the high byte and the low byte are the same, the failure of the byte select line would not be detected.

Another drawback of the present system is that any failure during a run condition would not be detected until the car comes to a stop. If a data bit stuck high during a down run, the magnitude of the reference error may be small enough to allow the car to come into the floor for a normal slowdown and landing. However, prior to dropping the brake, when the controller dictates zero speed, if a data bit is stuck high, the speed request detected by the static drive could be as much as 200% of rated speed.

SUMMARY OF THE INVENTION

The present invention is a control system in which control values are generated in a first processor and transmitted over a parallel interface to a second processor, which employs an improved digital protocol algorithm that provides continuous parallel interface integrity testing.

More particularly, a control system comprises a first processor that generates 16-bit control words and a 16-bit interface check word representing the ones complement of each control word. Preferably, each word is formed as two 8-bit bytes, which are transmitted sequentially to a second processor over an 8-bit parallel interface. The second processor compares each control word with its corresponding interface check word to detect any parallel interface hardware component failures. Preferably, the high and low bytes of the interface check word are swapped prior to transmission to the second processor, and the second processor swaps the high and low bytes of the interface check word, to restore them to the original order, prior to comparing.

In the preferred embodiment of an elevator, the first processor is part of the car logic controller, and generates speed reference control values $S_{REF}$ and pre-torque reference control values $I_{REF}$. The processor assigns a value of either zero or one to the most significant bit, to designate which parameter, i.e., either $S_{REF}$ or $I_{REF}$, the control word represents, and sets the remaining 15 bits to the numerical value of the selected parameter.

The second processor is part of the static drive, which generates control signals to control motor speed and initial pre-torque response to the values of $S_{REF}$ and $I_{REF}$ which it receives from the controller. In order to control the transmission of reference values between the controller and static drive, three additional single bit interfaces connect the controller and static drive: control word select, interface check word select, and byte select.

In operation, the static drive periodically transmits an interrupt signal to the controller, requesting a control word, by changing the bit of the control word select from "0" to "1". The controller monitors the bit select line, and upon receiving an interrupt signal generates a speed control word, if the speed reference value is not zero, or a pre-torque control word, if the speed reference value is zero, using the most significant bit of a 16-bit word to identify which parameter the control word represents. The controller then generates the ones complement of the control word, transposes the first and second bytes to form an interface check word, and transmits the control word and interface check word to the drive microcomputer. The drive microprocessor then performs an interface integrity test to ensure that valid data has been transmitted and received.

A control system according to the invention eliminates the need for separate registers for the speed reference and the pre-torque reference. Because the control word requires the use of only one of the two available registers, the remaining register can be used to transmit a 16-bit interface check word from the controller to the drive.

Because each transmission includes a control word and an interface check word, continuous parallel interface integrity testing is provided, so that any parallel interface hardware component failure is detected immediately after the failure occurs. Monitoring occurs both when the elevator is in motion and when it is stopped. Moreover, because the high and low bytes of the interface check word are transposed when transmitted, any failures in the byte select line will be detected when the interface check word is re-formed in the drive and compared with the control word.

Because each transmission includes a control word and an interface check word, corrupt data transmissions, resulting from an electrically noisy environment, are detected. Interface integrity testing may begin upon the completion of drive power up initialization, and the drive will not permit a run until it has received valid data from the controller. If valid data is not received before the run request, the drive will shut down the system.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
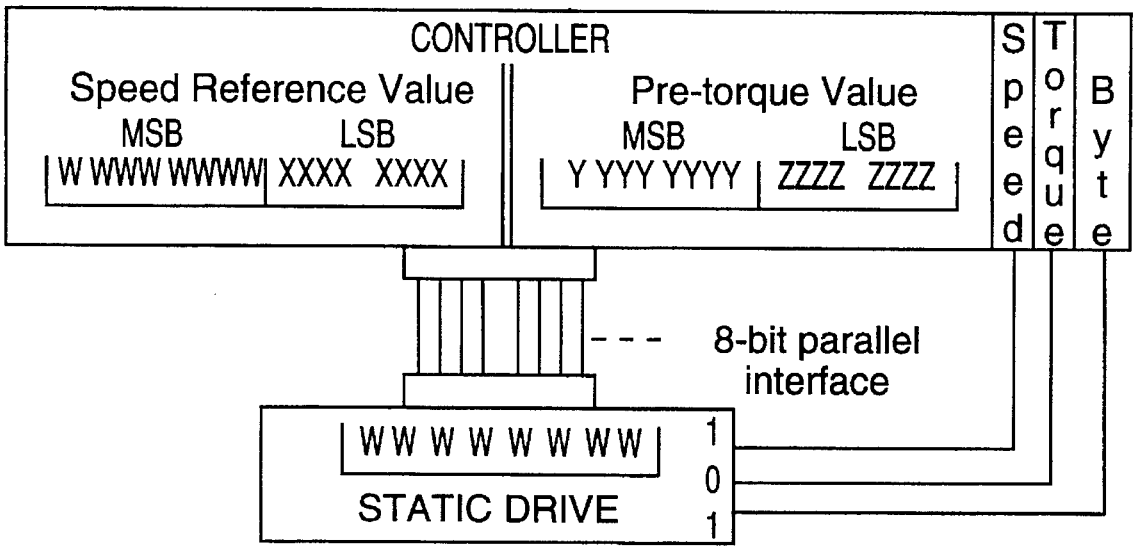
FIG. 1 PRIOR ART
FIG. 1 is a diagram of a known elevator controller and static drive, illustrating the transmission of speed reference and pre-torque reference values from the controller to the drive.
Figure 2:
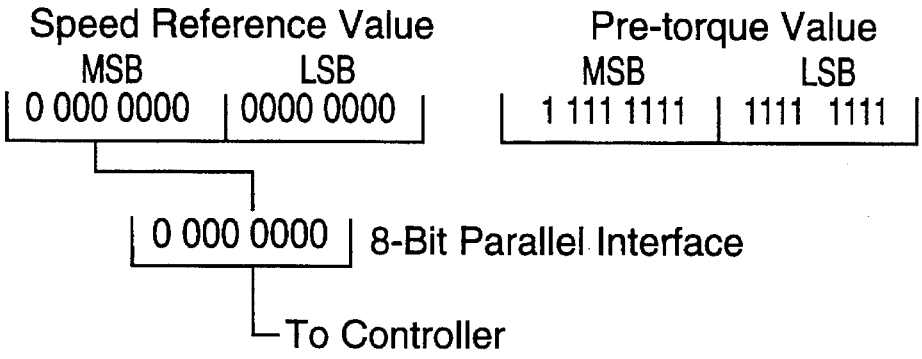
FIG. 2 PRIOR ART
FIG. 2 is a diagram illustrating a known parallel interface integrity test.
Figure 3:
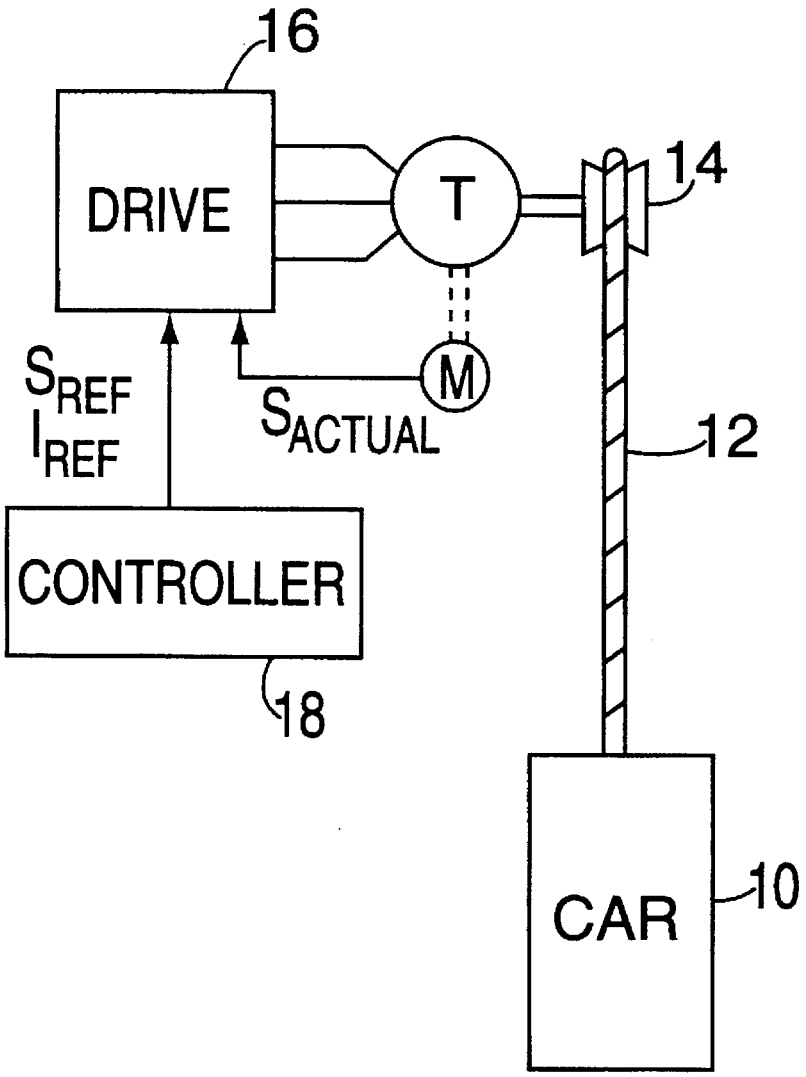
FIG. 3 is a schematic drawing of an elevator system according to the invention.

FIG. 3 illustrates several of the basic components of a traction elevator, including a car 10 suspended on a rope 12, which extends over a drive sheave 14 to a counterweight (not shown). The sheave 14 is driven by a motor M, which in the example shown in FIG. 1 is a variable voltage, variable frequency, three phase induction ac motor. The motor M, which may be either geared or gearless, is controlled by a static drive 16. A tachometer T generates signals representative of motor speed $S_{ACTUAL}$, which are transmitted to the drive 16. A car logic controller 18 generates speed command signals $S_{REF}$, as well as pre-torque command signals $I_{REF}$, which are transmitted to the drive 16 as well. While the exemplary embodiment has been described with reference to a three phase induction ac motor drive system, the invention may be employed in any elevator drive system which employs a processor controlled by digital speed command signals, which are supplied to the drive over a digital parallel interface.

Figure 4:
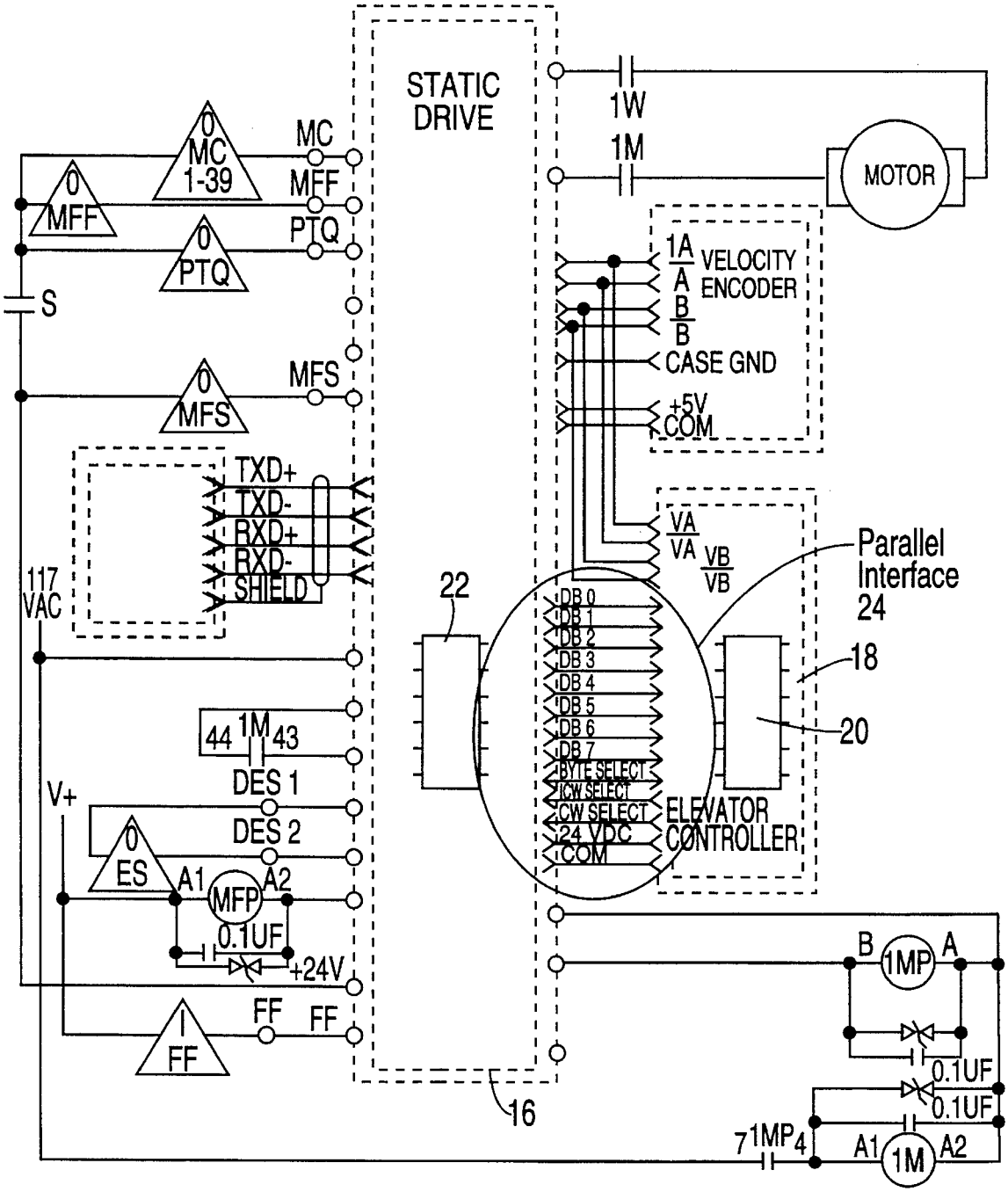
FIG. 4 is a schematic drawing of the controller, static drive, and digital parallel interface according to the invention.

Referring to FIG. 4, the elevator controller 18 includes a processor 20, and the static drive 16 includes a processor 22, which are linked by a parallel interface 24. The interface 24 includes an 8-bit data bus, labeled DB0 through DB7, which is controlled by the controller processor 20. The interface 24 also includes three logic lines, labeled "byte select", "ICW Select", and "CW Select", which are controlled by the drive processor 22. A 24 volt dc power line, and a dc ground line (labeled COM), are also connected between the elevator controller 18 and static drive 16.

The data bus DB0–DB7 carries a control word (CW) and an interface check word (ICW), each of which is a 16-bit (two byte) data word. The CW Select line acts as an interrupt, to signal the microprocessor to transmit either a speed control word or a pre-torque control word, as described below. The ICW Select line acts as an interrupt to transmit the interface check word ICW. The byte select logic signal selects either the low byte or the high byte of the 16-bit data word, i.e., byte select "high" selects the high byte of the word, whereas byte select "low" selects the low byte.

The hardware used for transmitting data may be the same as used in existing elevator systems, where the controller and drive each have a processor, a pair of two 16-bit registers, and a 8-bit parallel interface with additional data lines. Examples of suitable components are a programmable logic device 26 containing the two 16-bit registers, the optocouplers 28 that isolate the controller and drive logic signals, and the data line buffers 30. Further, the data in the two registers is transmitted in the same manner, i.e., sequentially in 8-bit segments. However, as described in further detail below, instead of the registers being used to hold a speed reference signal and pre-torque signal, one register of each pair holds a control word, whereas the other holds an interface check word.

Figure 5A:
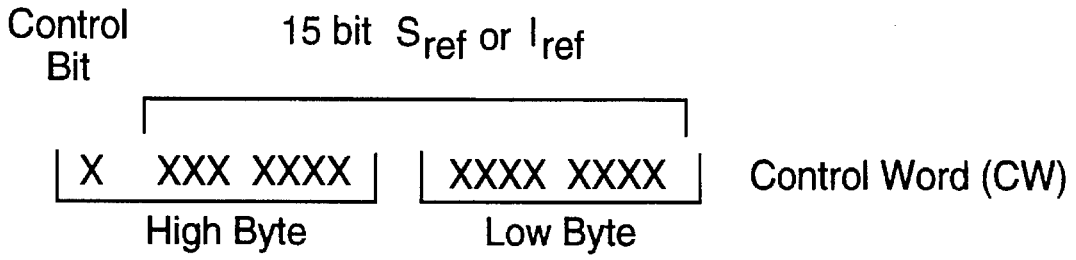
FIG. 5*a* is a diagram showing the composition of the control word.

The control word CW contains either the speed reference $S_{REF}$ or the pre-torque reference $I_{REF}$ for the drive. It is encoded with a control bit in the most significant bit location (bit 15) of the 16-bit word, as shown in FIG. 5*a*. By way of example, a control bit value of zero indicates that the data is a speed reference $S_{REF}$. A control bit value of one indicates that the data is a pre-torque reference $I_{REF}$. Speed reference $S_{REF}$ and pre-torque $I_{REF}$ are 15-bit, two's complement numbers as shown in the table below:

TABLE 1

| PARAMETER | HEX VALUE | REFERENCE EQUIVALENT |
|---|---|---|
| Speed Reference | 2000 | 100% contract speed up |
| $S_{REF}$ | 6000 | 100% contract speed down |
| Pre-Torque Reference | 2000 | 100% rated current up |
| $I_{REF}$ | 6000 | 100% rated current down |

Figure 5B:
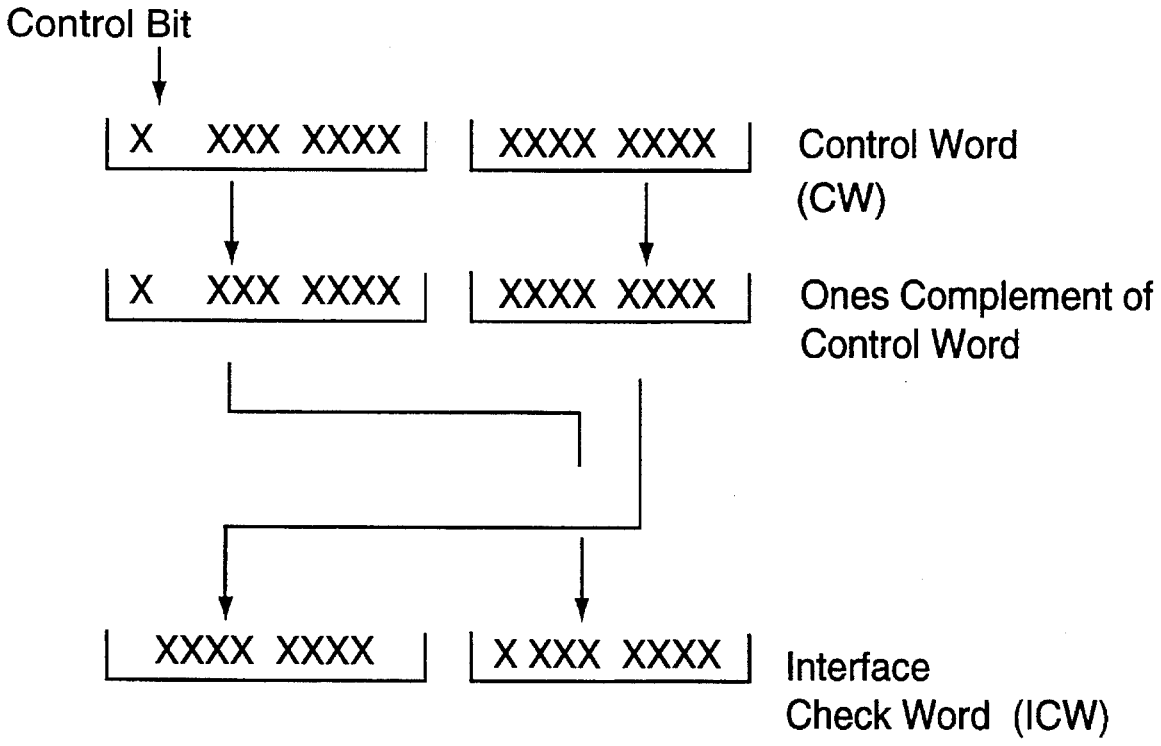
FIG. 5*b* is a diagram illustrating the generation of the interface check word.

The interface check word ICW is formed from the control word and is used to verify the integrity of the parallel interface. To generate the ICW, the controller processor 20 forms the ones complement of the control word, and transposes the low byte and high byte. This is shown in FIG. 5*b*.

Figure 6:
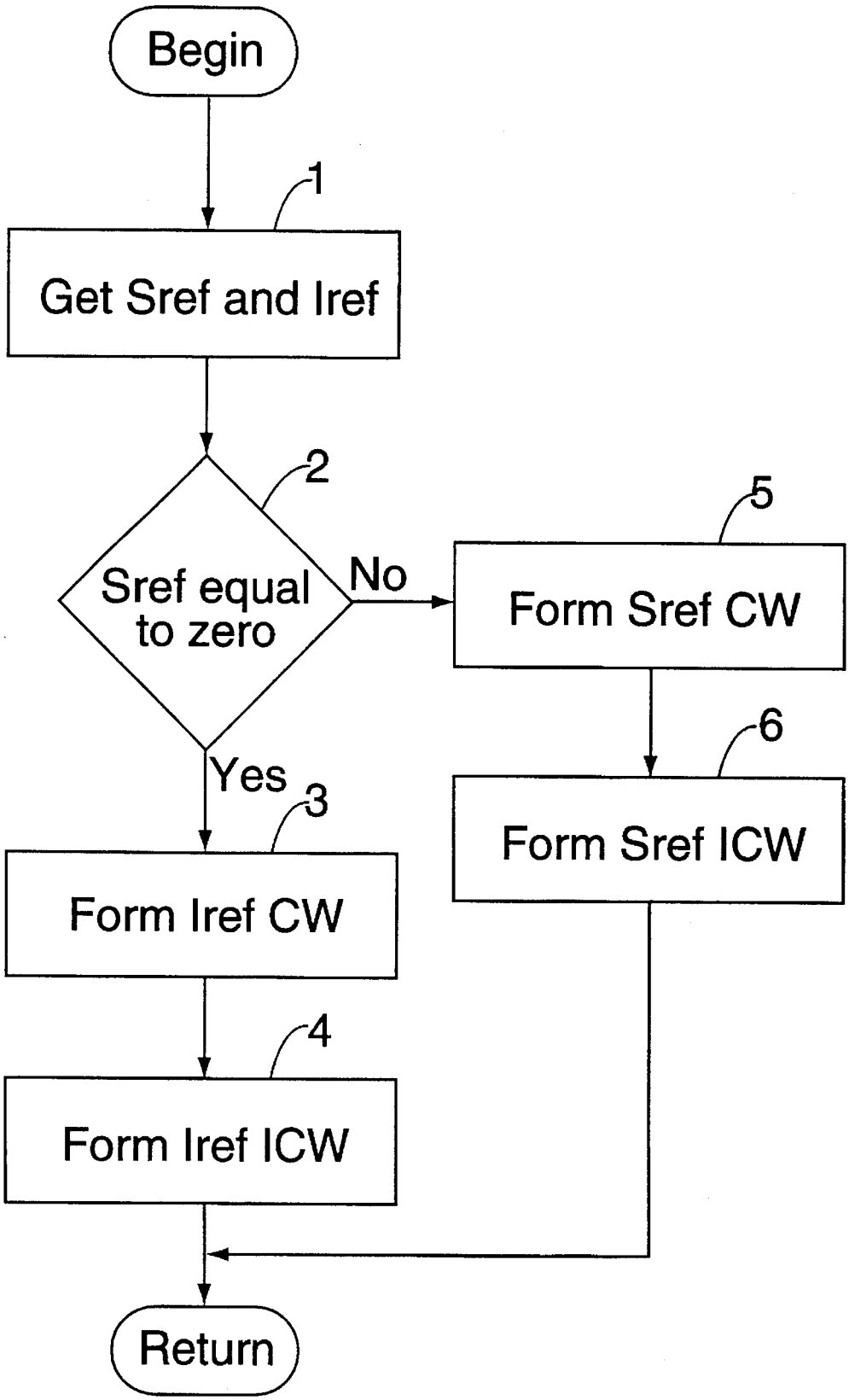
FIG. 6 is a flow chart of the parallel interface protocol algorithm.

Referring to FIG. 6, which shows the parallel interface algorithm, the controller processor 20 fetches the speed and pre-torque references (step 1), which are generated and updated separately. Speed control generation algorithms are well known and need not be described here.

Processor 20 checks the speed reference for zero value (step 2). If the speed value is not zero, the processor generates a speed reference control word (step 5), together with its interface check word ICW (step 6). If, however, a zero speed reference is detected, indicating that the car is stopped, the processor generates a pre-torque control word $I_{REF}$ (step 3), rather than a speed control word, together with its interface check word ICW (Step 4).

Figure 7A:
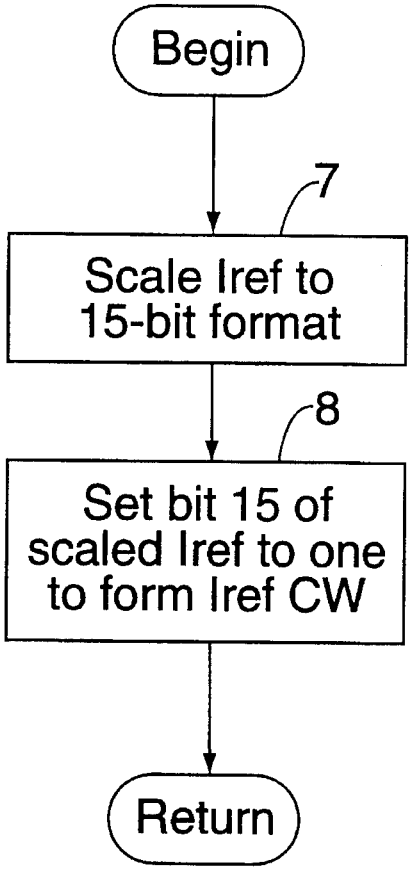
FIG. 7*a* and 7*b* are flow charts showing the generation of the pre-torque reference control word and the corresponding interface check word.

FIG. 7*a* is a flow chart detailing step 3 of FIG. 6, i.e., forming the pre-torque control word. The input $I_{REF}$ is scaled to the 15-bit format shown in Table 1 (step 7), and bit 15 is set to "one" to designate that the control word is $I_{REF}$ (step 8).

Figure 7B:
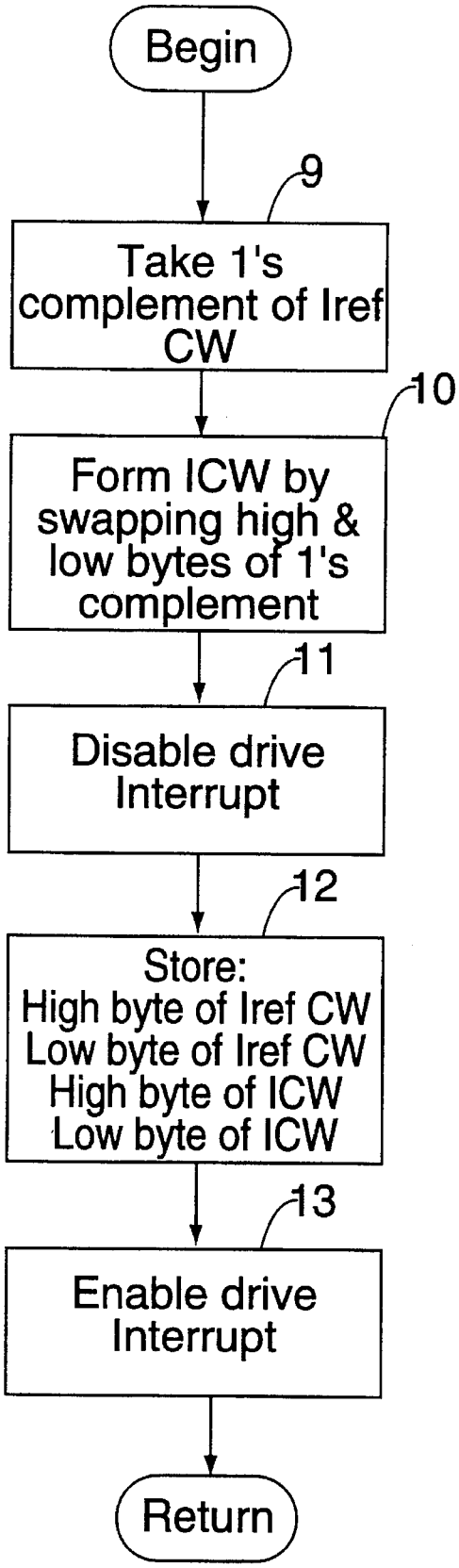

FIG. 7*b* is a flow chart detailing step 4 of FIG. 6, i.e., forming the interface control word. The one's complement of the control word CW is formed (step 9), and the high and low bytes are swapped (step 10). In step 11, the interrupts from the drive to the controller are disabled so that the high and low bytes of the CW and ICW may be stored (step 12) in the microprocessor's data RAM without being interrupted, thus avoiding the possibility of sending corrupt data to the drive due to an incomplete storage process. Once step 12 is completed, the interrupts are enabled again (step 13).

Figure 8A:
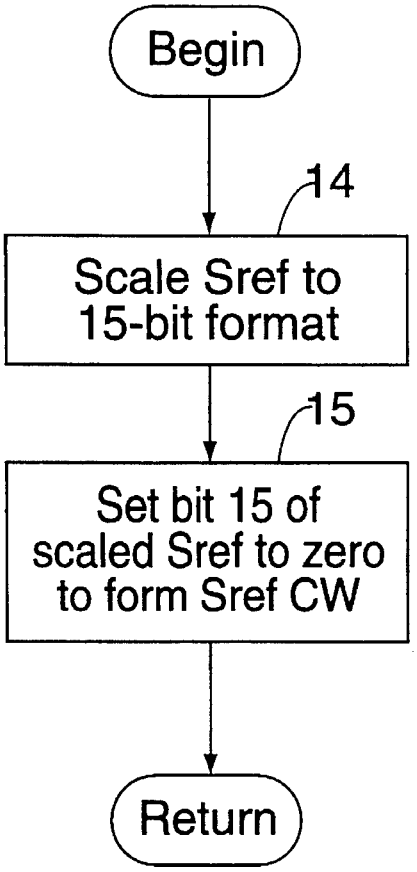
FIGS. 8*a* and 8*b* are flow charts showing the generation of the speed reference control word and the corresponding interface check word.

FIG. 8*a* is a flow chart detailing step 5 of FIG. 6. In step 14, the input $S_{REF}$ is scaled to a fifteen bit format, as shown in Table 1. Bit fifteen is then set to zero, to designate that the control word CW represents $S_{REF}$.

Figure 8B:
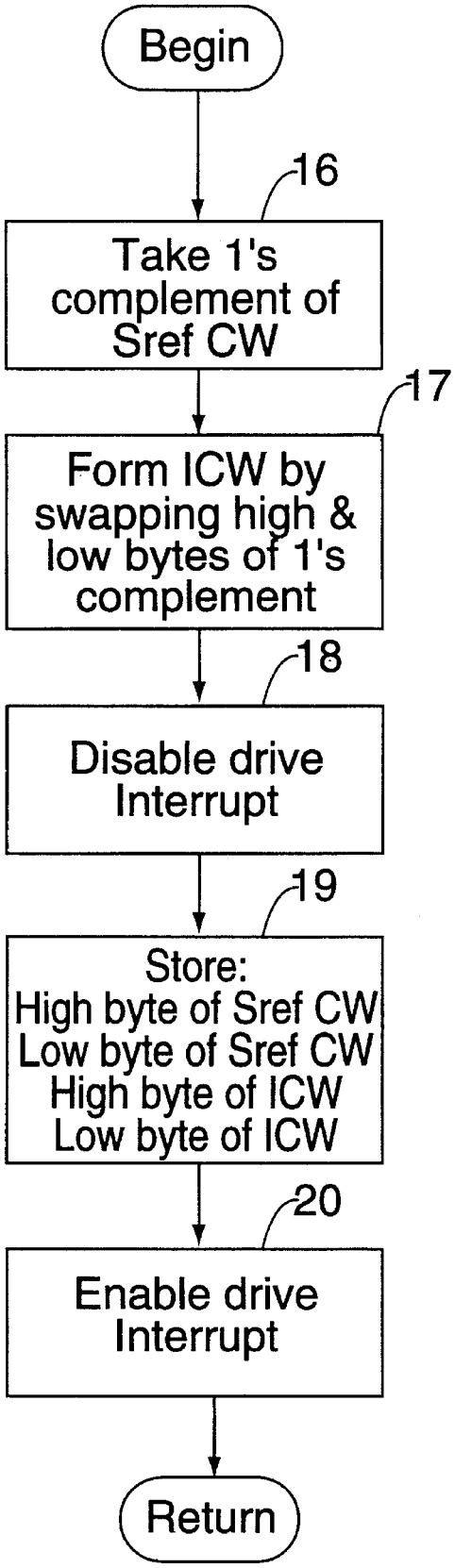

FIG. 8*b* is a flow chart detailing step 6 of FIG. 6. The one's complement of the control word CW is formed (step 16), and the high and low bytes are swapped (step 17). In step 18, the interrupts from the drive to the controller are disabled during the storage of the control and ICW words (step 19) to the microprocessor's data RAM. Once step 19 is completed, the interrupts are enabled again (step 20).

Figure 9:
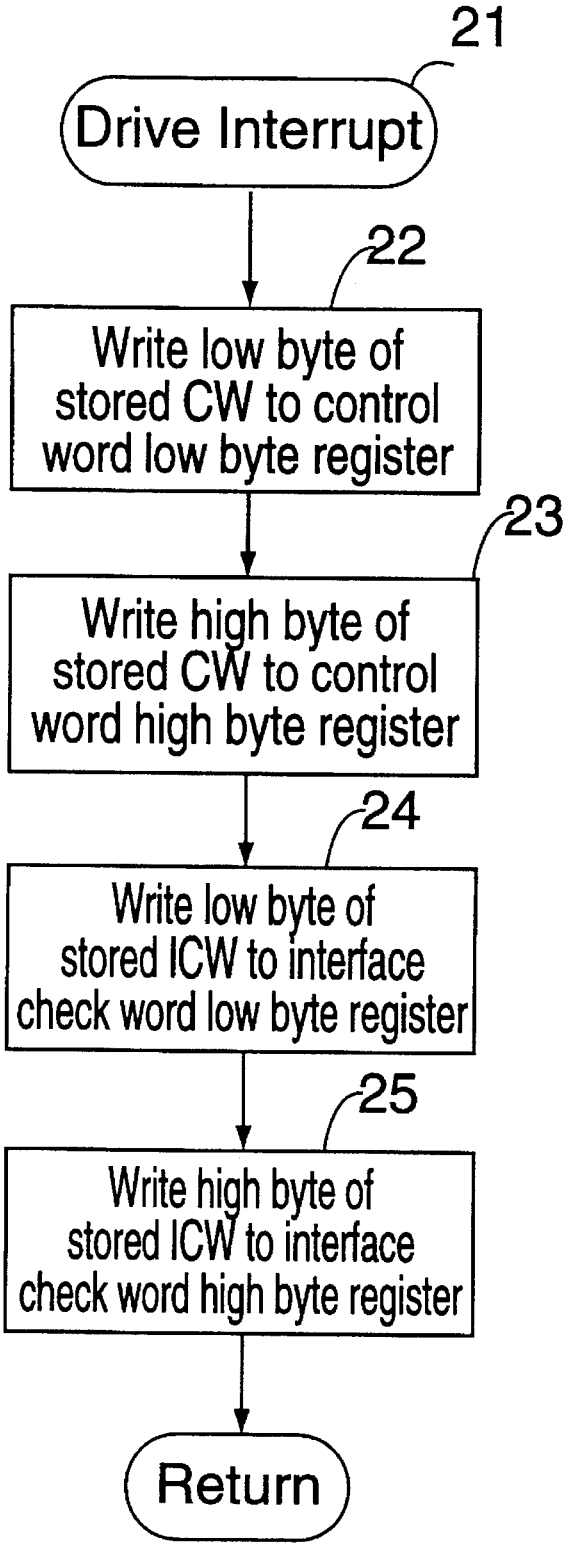
FIG. 9 is a flow chart showing the controller write sequence upon receiving an interrupt from the drive.

Referring to FIG. 9, when the controller processor 20 is interrupted by the drive (step 21), the controller writes the low byte of the stored CW to the control word low byte register of the drive (step 22), writes the high byte of the stored CW to the control word high byte register (step 23), writes the low byte of the stored ICW to the interface check word low byte register (step 24), and writes the high byte of the stored ICW to the interface check word high byte register (step 25).

Figure 10:
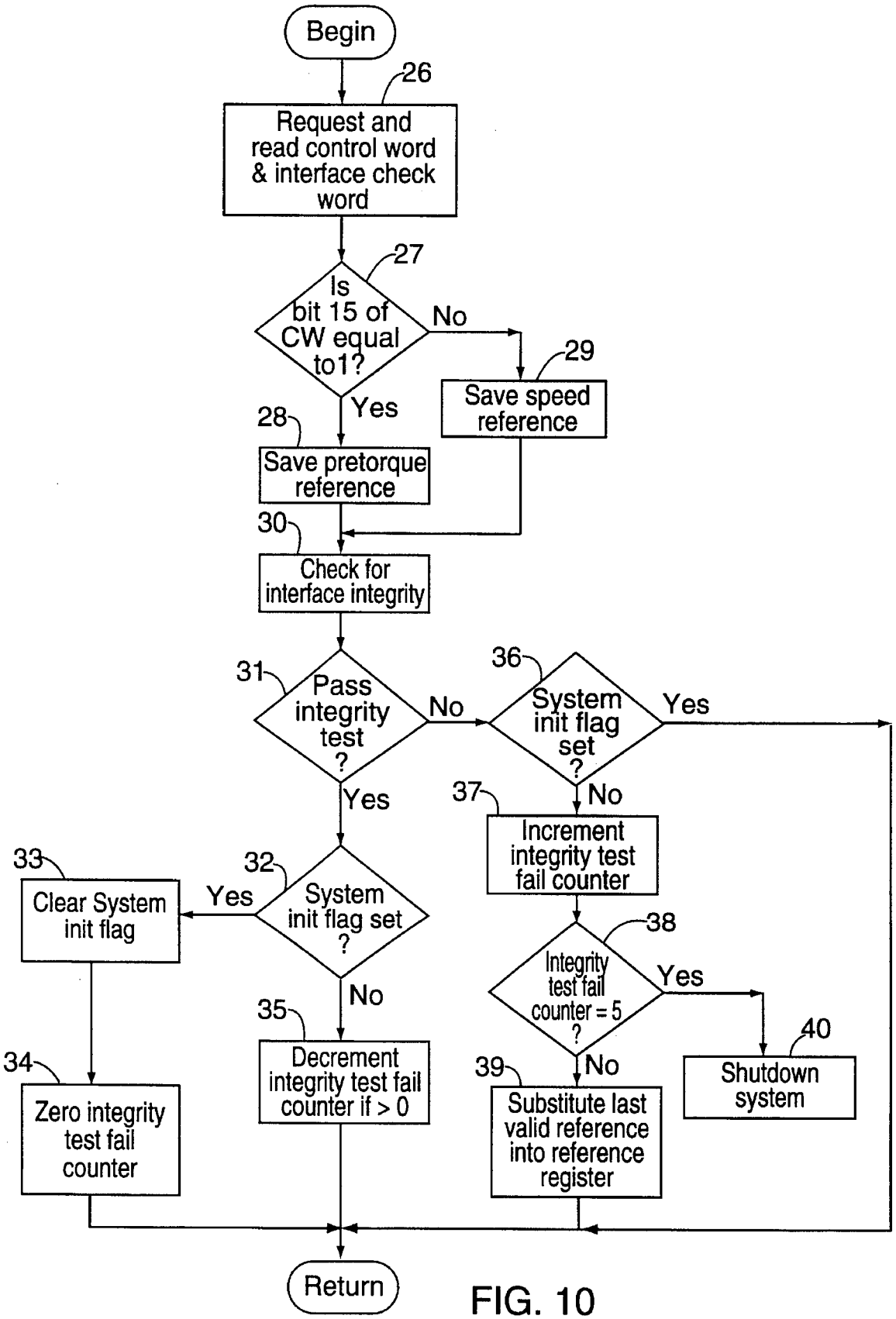
FIG. 10 is a flow chart showing the static drive read reference algorithm.

The static drive monitors the parallel interface immediately upon completion of power up initialization routines. This is possible primarily because it can run the integrity test and not accept a run request until it reads the first transfer of valid data. The data acquisition process is shown in FIG. 10. Before entry into the parallel interface read reference algorithm, the drive sets a system initialization flag during its power up initialization.

In this algorithm, the drive requests and reads the control word and interface check word (step 26). Bit 15 of the control word is checked for its value in step 27 and, depending whether it is set, the control word is saved either as a pre-torque reference (step 29) or a speed reference (step 29). The interface integrity test is checked (step 30). If the integrity test passes (step 31), the system initialization flag is checked (step 32). If the flag is set, it is cleared (step 33), the interface integrity test fail counter is set to zero (step 34), and the algorithm ends.

If the system initialization flag is not set in step 32, the integrity test fail counter is decremented if it is greater than zero and the algorithm ends.

If the parallel interface fails the integrity test (step 31), the drive determines the state of the initialization flag (step 36). If the flag is not set, the integrity test fail counter is incremented (step 37) and tested for a fail count of 5 (step 38). If there have been less than 5 failures, the last valid control word read is loaded into the speed or pre-torque reference register (step 39) and the algorithm is ended. If the failure represents the fifth data transmission error, the system is shut down (step 40).

As shown in FIG. 10, the system initialization flag remains on until at least one successful data transmission is completed (steps 31 and 33). If the drive receives a run request before the system initialization flag is cleared, the system is shut down. The drive receives a run command separate from receiving a speed request.

Figure 11:
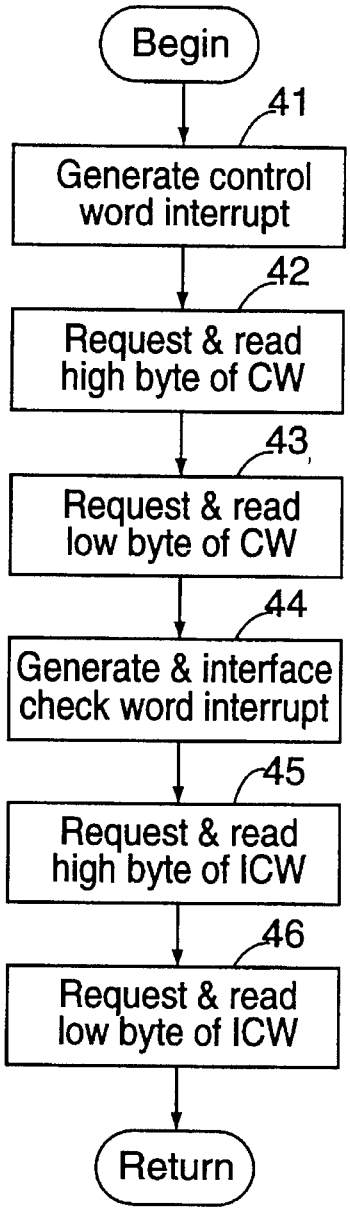
FIG. 11 is flow chart showing the drive interrupt and read control word and interface check word.

FIG. 11 details step 26 of FIG. 10 (request and read CW and ICW). The drive interrupts the controller for the control word to be updated (step 41). In steps 42 and 43, the drive requests and reads the high and low bytes of the control word. The drive then interrupts the controller for the interface check word (step 44), and reads the ICW from the parallel interface (steps 45 and 46), ending the algorithm.

Figure 12:
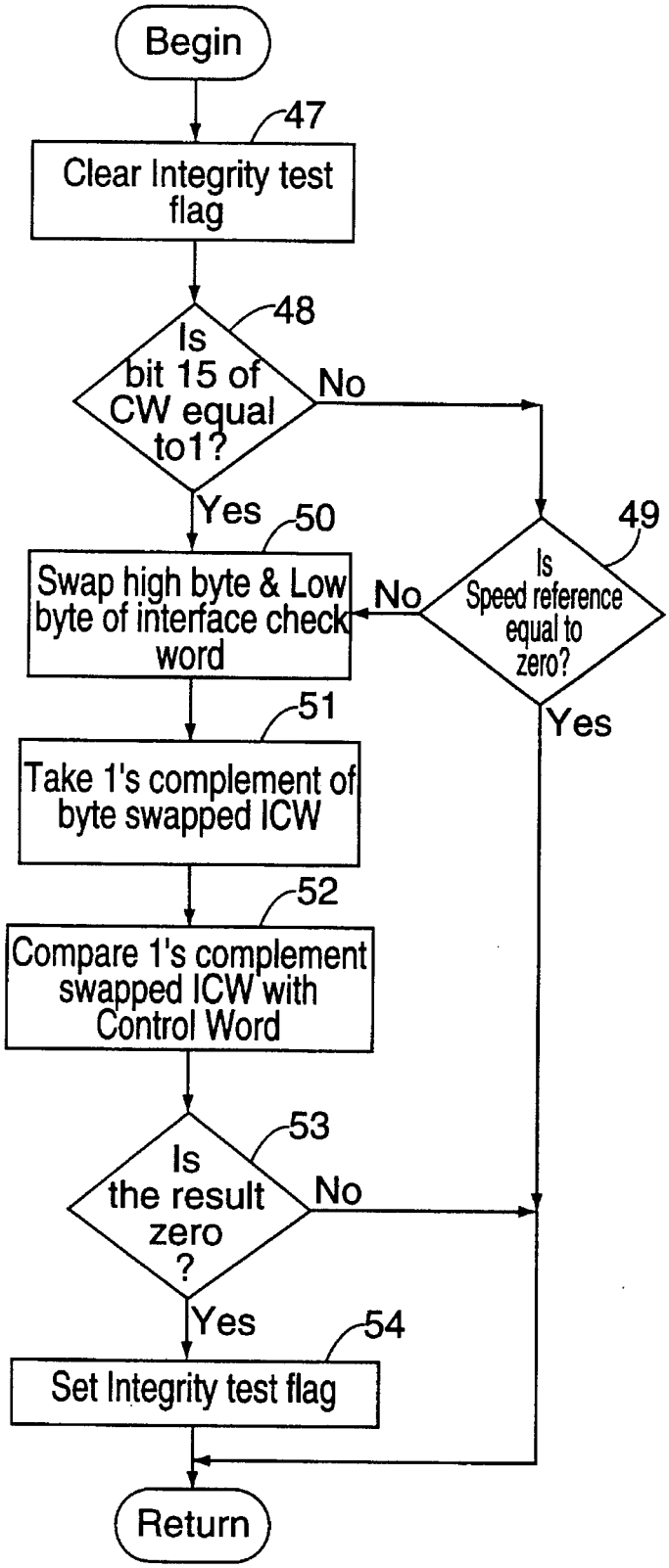
FIG. 12 is a flow chart showing the algorithm for the drive interface integrity test.

FIG. 12 is a flow chart that details step 30 of FIG. 10 (check interface integrity). In step 47, the integrity test flag is cleared. The state of bit 15 is determined (step 48). If the bit is zero, the word is assumed to be a speed reference and is checked for a value of zero (step 49). If the speed reference is zero, the algorithm ends without setting the integrity test flag. If the speed reference is not zero, or the control word bit is equal to one (indicating that it is a pre-torque control word), the high and low bytes of the interface control word are swapped (step 50). The ones complement of the result is formed (step 51), and the result is compared with the control word CW (step 52). If the result is equal to zero (step 53), the integrity test flag is set (step 54), indicating that the test has been passed, and the algorithm ends. If the values are not equal, the algorithm ends without setting the integrity test flag.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

We claim:

1. A control system comprising:

a first processor including means for generating 16-bit control words representing control values, and means for generating a 16-bit interface check word for each control word, wherein each control word and interface check word has an 8-bit high byte and an 8-bit low byte, and wherein the means for generating interface check words comprises means to form the ones complement of the high byte and low byte of the control word and then swap the high and low bytes;

a second processor having means for receiving and storing the control words and corresponding interface check words, means for comparing each control word with its corresponding interface check word, and means for generating an error signal where an interface check word is not the ones complement of the corresponding control word, wherein the means for comparing each control word with its corresponding interface check word includes means for swapping the high and low bytes of the interface check word prior to comparing; and an 8-bit parallel interface connecting the first and second processors, wherein the first processor includes means for transmitting sequentially the high and low bytes of the control words and interface check words to the second processor over the parallel interface, whereby the integrity of said parallel interface is tested each time a control word is transmitted.

2. An elevator comprising a motor and a speed control system, wherein the speed control system comprises a static drive for controlling the speed of the motor, and a controller for sending at least speed control signals to the static drive, wherein the controller comprises:

a first processor including means for generating 16-bit control words representing control values, and means for generating a 16-bit interface check word for each control word, wherein each control word and interface check word has an 8-bit high byte and an 8-bit low byte, and wherein the means for generating interface check words comprises means to form the ones complement of the high byte and low byte of the control word and then swap the high and low bytes; wherein the static drive comprises:

a second processor having means for receiving and storing the control words and corresponding interface check words, means for comparing each control word with its corresponding interface check word, and means for generating an error signal where an interface check word is not the ones complement of the corresponding control word, wherein the means for comparing each control word with its corresponding interface check word includes means for swapping the high and low bytes of the interface check word prior to comparing; and wherein the control system further comprises:

an 8-bit parallel interface connecting the first and second processors, wherein the first processor means further includes means for transmitting sequentially the high and low bytes of the control words and interface check words to the second processor over the parallel interface, whereby the integrity of said parallel interface is tested each time a control word is transmitted.

3. An elevator according to claim 2, wherein the first processor includes means to generate control words representing either a speed reference value or a pre-torque reference value, wherein each control word includes a most significant bit, wherein the first processor includes means to assign a value to the most significant bit representing the type of control word generated, and means to set the remaining 15 bits of each control word based on the numerical value of the respective parameter.

4. A method of operating an elevator having a motor and a speed control system, wherein the speed control system comprises a static drive for controlling the speed of the motor, and a controller for sending at least speed control signals to the static drive, wherein the controller comprising the steps of:

generating 16-bit control words, each in the form of an 8-bit high byte and an 8-bit low byte, representing control values, in the controller;

generating a 16-bit interface check word, in the form of an 8-bit high byte and an 8-bit low byte, for each control word, by forming the ones complement of the high byte and low byte of the control word and then swapping the high and low bytes;

transmitting sequentially the high and low bytes of the control words and corresponding interface check words from the controller to the static drive over a parallel interface;

storing the control words and corresponding interface check words in the static drive;

re-swapping the high and low bytes of the interface check word in the static drive;

comparing, after re-swapping the high and low bytes of the interface check word, each control word with its corresponding interface check word; and generating an error signal where an interface check word is not the ones complement of the corresponding control word, whereby the integrity of said parallel interface is tested each time a control word is transmitted.

5. A method according to claim 4, comprising further the steps of generating control words representing a speed reference value and control words representing a pre-torque reference value, assigning a value to the most significant bit of the word representing the type of control word generated, and setting the remaining 15 bits of each control word based on the numerical value of the respective parameter.

* * * * *